United States Patent [19]

Jahn

[11] Patent Number: 4,722,167

[45] Date of Patent: Feb. 2, 1988

[54] NON-SMEAR FOOD PACKAGE AND PROCESS FOR MAKING SAME

[75] Inventor: Robert E. Jahn, Greer, S.C.

[73] Assignee: W.R. Grace & Co., Cryovac Div., Duncan, S.C.

[21] Appl. No.: 928,938

[22] Filed: Nov. 10, 1986

[51] Int. Cl.[4] ..... B65B 11/02; B65B 51/10

[52] U.S. Cl. ..... 53/449; 53/441; 53/463

[58] Field of Search ..... 53/449, 465, 463, 173, 53/210, 441, 477; 426/129, 396

[56] References Cited

U.S. PATENT DOCUMENTS

| | | | |
|---|---|---|---|
| 3,171,238 | 3/1965 | Dreyfus | 53/442 |
| 3,429,098 | 2/1969 | Treiber | 53/463 |
| 4,624,239 | 2/1987 | Ferrar | 426/396 |

*Primary Examiner*—John Sipos

*Attorney, Agent, or Firm*—John J. Toney; William D. Lee, Jr.; Mark B. Quatt

[57] ABSTRACT

Smearing of fat by fat-containing trayed food products on the interior surface of a thermoplastic overwrap is substantially reduced or eliminated by applying loading forces during a sealing step to the longitudinal edges of the tray containing food product. A tray with a convex bottom is preferred to enhance the quality of the seal. A convex heating plate can be used in conjunction with conventional trays.

1 Claim, 8 Drawing Figures

NON-SMEAR FOOD PACKAGE AND PROCESS FOR MAKING SAME

BACKGROUND OF THE INVENTION

This invention pertains to the packaging of food products using thermoplastic films, and particularly, to overwrapping thermoplastic film around fat-containing meat products.

It is common practice to package food products, particularly meat products such as whole chicken and chicken parts, by placing the food product in a tray such as a polystyrene tray, overwrapping the trayed food product with a thermoplastic film, overlapping the edges of the film along the bottom of the tray, and sealing the overlapped edges. A sealing apparatus such as a sealer/cooler is typically used to seal the overwrapped film and then cool the packaged product prior to further processing.

In order to ensure an adequate seal in the overlapped areas of the film, at the bottom of the tray, the overwrapped, trayed product is pressed down against the conveyor belt under which the heat sealing means is disposed. Pressure is applied by, for example, an overhead belt, such as shown in U.S. Pat. No. 3,171,238, and typically brings the pressing means in contact with the top surface of the thermoplastic film.

When packaging fat-containing meat products such as pork chops, whole chicken, chicken parts, and similar fat-containing products, the downward pressure exerted on the package during the sealing cycle often results in smearing of fat on the interior surface of the thermoplastic film. The packages produced by this process are often retail packages which will be presented to the consumer without further repackaging. In the event of fat-smearing on the film, an aesthetically inferior package results. This can result in lost sales and reduced consumer demand if the problem is not corrected.

It is, therefore, an object of the present invention to provide an improved food package and method for making such a package wherein the fat-smearing problem related to fat-containing food products is substantially reduced or eliminated.

It is yet another object of the present invention to provide a food package and method for making same wherein smearing of fat from a fat-containing food product on a thermoplastic overwrapped film during the sealing step is substantially reduced or eliminated, without substantially reducing the quality of the heat seal formed in the sealing step.

SUMMARY OF THE INVENTION

In a method of packaging a fat-containing food product comprising placing the food product on a tray having raised walls around the periphery of the tray, overwrapping the tray and food product contained therein with a thermoplastic film, overlapping the edges of the film on the bottom of the tray, and sealing the overlapped edges of the film, the improvement comprises applying a loading force on the longitudinal edges of the tray, as the film edges are sealed, to reduce the smearing of fat on the interior surface of the film above the product during the sealing step.

In another aspect of the present invention, in a tray suitable for carrying a fat-containing food product overwrapped in a thermoplastic film, said tray having raised walls around the periphery thereof, the improvement comprises a convex bottom of the tray, wherein the interior surface of the tray bottom has a substantially flat profile, and the exterior surface of the tray bottom has a convex profile.

In yet another aspect of the invention, in an apparatus for sealing the overlapped edges of thermoplastic film along the bottom of a tray, the improvement comprises a heating plate having an upper convex surface whose curvature substantially corresponds to the concavity of the bottom of the tray during flexure of the tray during a sealing step.

In another aspect of the invention, in an apparatus for sealing the overlapped edges of thermoplastic film along the bottom of a tray, the improvement comprises angular powered belts disposed to contact longitudinal edges of a food tray as the tray is passed through the apparatus, said belts capable of providing a load on the edges sufficient to effect sealing of the film along the bottom of the tray without substantial fat smearing on the upper interior surface of the thermoplastic film.

BRIEF DESCRIPTION OF THE DRAWINGS

Referring to the accompanying drawings illustrating preferred embodiments of the present invention.

DESCRIPTION OF THE PREFERRED EMBODIMENTS

Figure 1:
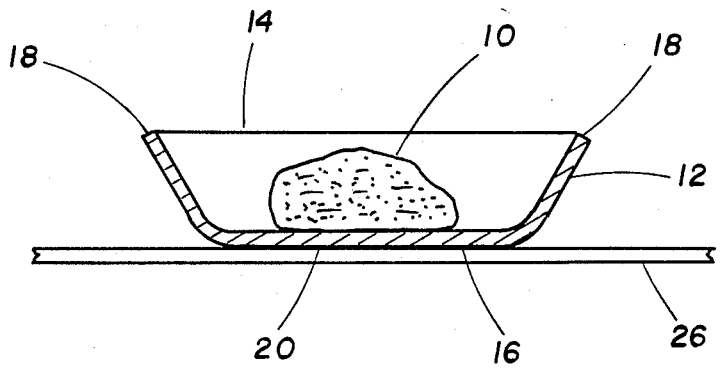
FIG. 1 (PRIOR ART)
FIG. 1 is a cross-sectional view of a conventional trayed and overwrapped food product.

Referring to FIG. 1, in a conventional commercial method of packaging food products, a food product 10 is placed in a tray 12 which typically has raised walls around the periphery of the tray, and is often made from polystyrene or similar material. For purposes of illustration, the tray of FIG. 1 and the remaining figures is vertically exaggerated. A thermoplastic film 14 is wrapped over the top and around the sides of the trayed food product and the ends of the film are brought together in overlapping relationship along the bottom exterior surface of the tray 12. For purposes of clarity, film 14 is only depicted as stretched across the top portion of the tray, contacting the tray at edges 18 of tray 12. In fact, the film wraps around the edges along the side walls, and overlaps at the bottom 16 of the tray 12.

Figure 2:
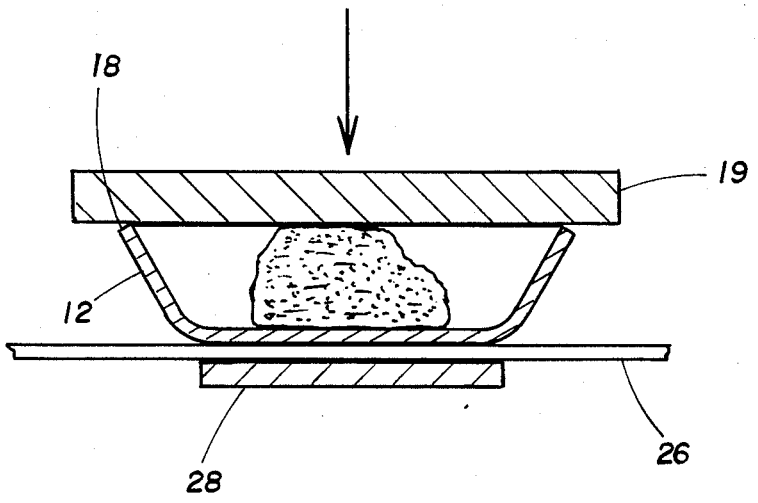
FIG. 2 (PRIOR ART)
FIG. 2 is a cross-sectional view of the trayed and overwrapped food product of FIG. 1 during application of a loading force along the upper surface of the thermoplastic film.

Referring now to FIG. 2, it is well known in the art to apply a loading force along the top of the package formed by the trayed and overwrapped food product, the loading means shown schematically at 19, the loading force being applied substantially along the entire upper surface of the thermoplastic film 14 in the direction shown by the arrow. A loading force of about 10 pounds is commonly used.

The loading force is usually applied while the trayed overwrapped food product is passed through a sealing apparatus on a conveyor belt 26 with conventional heat sealing means 28 beneath the conveyor belt to effect a seal of the overlapped edges of the film along the bottom surface 16 of tray 12.

This method of packaging and sealing a food product is effective in providing an integral package which securely encloses the food product. However, when packaging meat products, particularly fat-containing meat products such as pork chops, chicken, and the like, the loading means depicted schematically in FIG. 2 presses the upper interior surface of thermoplastic film 14 against the food product 10, resulting in undersirable smearing of fat along the interior upper surface of film 14.

Figure 3:
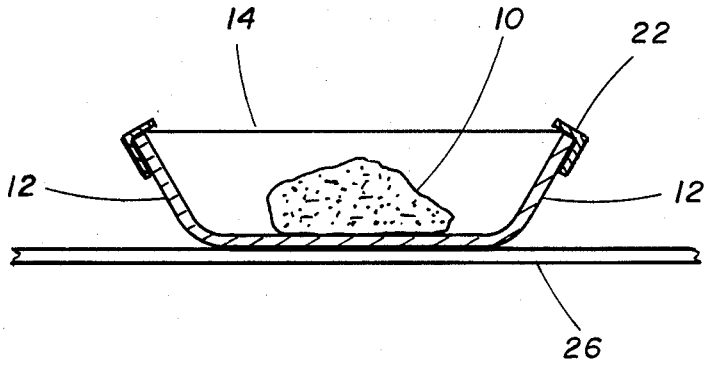
FIG. 3 is a cross-sectional view of a trayed and overwrapped food product in accordance with the present invention.
Figure 4:
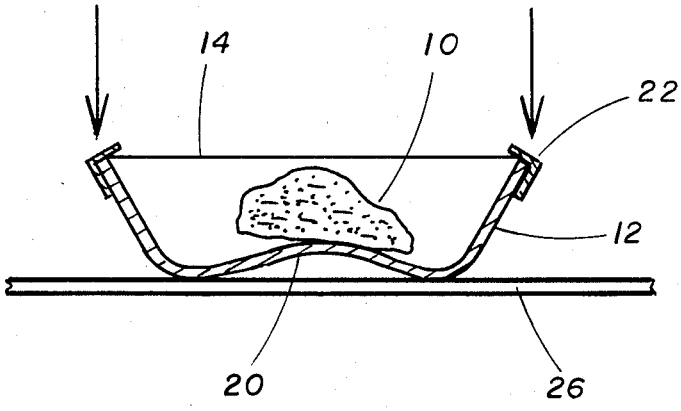
FIG. 4 is a cross-sectional view of the trayed and overwrapped food product of FIG. 3 upon the application of a load to the outer edges of the tray.

The present invention provides an improved method of introducing a loading force to the tray 12 while at the same time avoiding substantial smearing of fat along the interior surface of film 14. This is accomplished by applying the loading force only along the longitudinal edges of the tray. One method of applying the force is by means of angular powered belts which exert a downward force on the tray during the passage of the tray through a sealing apparatus such as a sealer-cooler. As illustrated in FIGS. 3 and 4, this arrangement assures a loading force downward against the tray edges to force the loaded tray against conveyor belt 26 and provide a heat seal to overlapped edges of film 14. At the same time, contact of the top interior surface of film 14 against the food product is either eliminated or substantially reduced, resulting in an aesthetically superior package.

Using this procedure on conventional trays, the overlapped film on the bottom 16 of tray 12 seals well in the vicinity of the bottom peripheral areas of the tray 12, but does not seal well in the central area 20 of tray 12. This uneven sealing performance results from the peripheral loading placed only on the tray edges 18, causing the tray to bend into a slightly concave shape.

Figure 5:
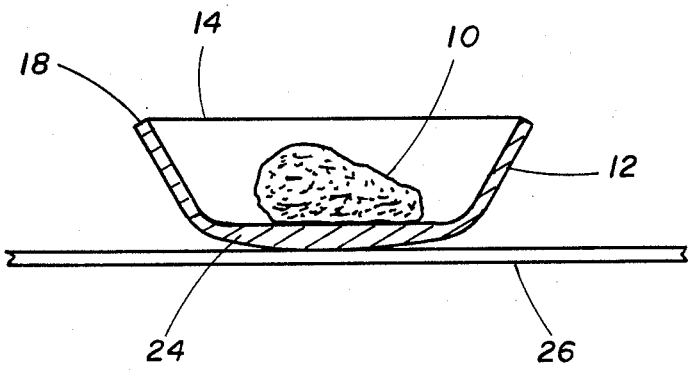
FIG. 5 is a cross-sectional view of a trayed and overwrapped food product including an improved tray.
Figure 6:
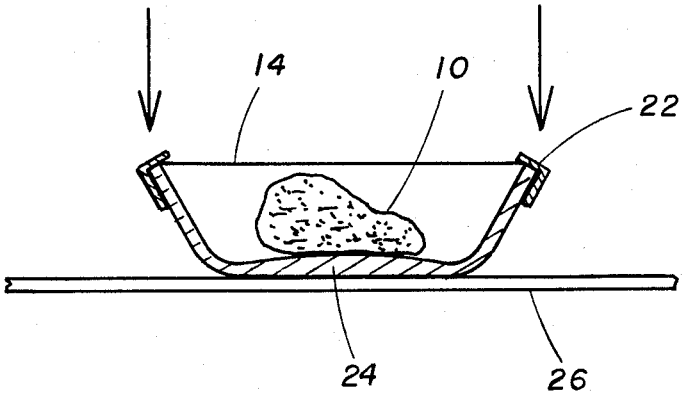
FIG. 6 is a trayed, overwrapped food product of FIG. 5 after application of a load along the longitudinal edges of the tray.

To improve the bottom seal using edge loading of tray 12, an alternate tray is preferred having a convex bottom section 24 depicted in FIGS. 5 and 6. In a preferred embodiment, a load is exerted by means of angular powered belts on the longitudinal edges of the tray, in the direction of the arrows illustrated in FIG. 6, and the convex tray 12 deforms to create an essentially flat bottom surface. This method permits a product to be hermetically packaged with an adequate heat seal along the bottom surface 16 of tray 12, but without the undesirable smearing of fat along the upper interior surface of film 14. The convex shape of the bottom portion of tray 12, in accordance with the present invention, produces a distribution of the load when the loading force is applied to the edges 18 of tray 12.

Figure 7:
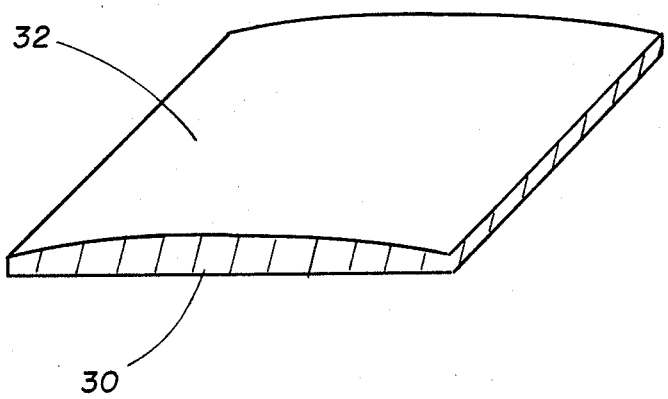
FIG. 7 is a perspective view of a modified heating plate in accordance with an alternate embodiment of the invention.
Figure 8:
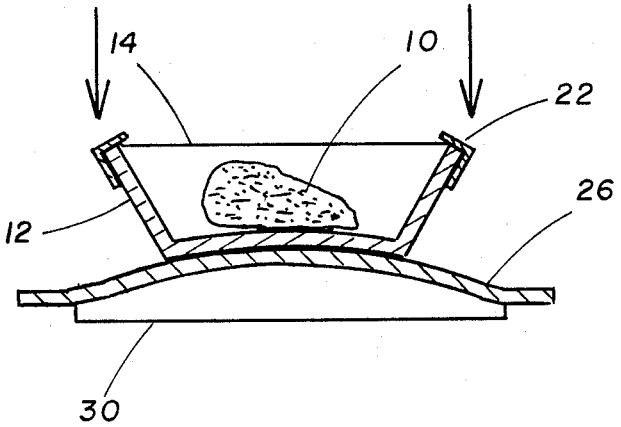
FIG. 8 is a front view of the modified heating plate of FIG. 7.

In an alternate embodiment, the use of special trays as described above may be unnecessary if other means are provided to insure adequate sealing of the film not only in the bottom peripheral area, but also in the bottom central area of tray 12. This may be accomplished by the use of a convex heating plate 30 as illustrated in FIGS. 7 and 8. The degree of curvature of surface 32 of the heating plate 30 can be matched to the curvature of the bottom portion 16 of tray 12 when a load is applied by means of the angular power belts 22. It will be recognized that the heating plate 30, like heating plate 28 of FIG. 2, conducts heat to the overlap portions of film 14 by means of belt 26, typically a Teflon belt.

EXAMPLE 1

Styrofoam trays were overwrapped in a thermoplastic film, and were clamped in a temporary jig to simulate a production run in a modified sealer-cooler equipped with angular powered belts to provide the loading force to the trays. Applying a load to the wrapped tray in the above manner created a convex bottom on the tray which allowed the overlapped areas of the film to be sealed along the bottom edges of the tray, but did not provide good contact between the sealer-cooler belt, the film, and the tray along the bridged area in the central portion of the overlapped film.

EXAMPLE 2

A styrofoam tray was fabricated having a convex bottom configuration. When a loading force was exerted on the longitudinal edges of the tray, the convex bottom defected to a flat surface with good sealing pressure distribution over the entire base of the tray.

EXAMPLE 3

A conventional styrofoam tray was overwrapped in thermoplastic film and subjected to a loading force on the longitudinal edges of the tray by means of angular powered belts. A heating plate having a convex upper surface was used, instead of a standard heating plate, in the sealer/cooler. The curvature of the upper convex surface of the heating plate was predetermined to match the curvature of the bottom of the tray caused by application of a loading force to the longitudinal edges of the tray. The overwrapped film sealed satisfactorily along the bottom surface of the tray upon application of heat to the film through a teflon belt.

It will be evident to one skilled in the art that various modifications may be made after review of the invention without departing from the spirit and scope of the claims that follow. For example, other suitable means may be employed for applying downward loading force to tray edges 18. An important feature of the present invention is the substantial reduction or elimination of fat-smearing caused by contact of a fat-containing food product with the upper interior surface of the thermoplastic film overwrap during loading of the overwrapped trayed product during the sealing step.

What is claimed is:

1. A method of packaging a fat-containing food product comprising:

(a) placing the fat-containing food product on a tray having
  (1) raised walls around the periphery thereof, said walls having longitudinal and transverse edges respectively, and
  (2) a convex exterior bottom surface;
(b) overwrapping the tray and food product contained therein with a thermoplastic film;
(c) overlapping the film in the bottom peripheral area, and in the bottom central area of the tray;
(d) applying a loading force on the longitudinal edges of the tray;
(e) distorting the convex bottom of the tray, while applying the loading force, to a substantially flat bottom profile; and
(f) sealing the film, while applying the loading force and distorting the convex bottom of the tray, in both the bottom peripheral area and bottom central area of the tray.

* * * * *